United States Patent [19]

Stolarski et al.

[11] Patent Number: 4,924,554

[45] Date of Patent: May 15, 1990

[54] PROCESS AND MANIPULATOR FOR THE GUIDANCE OF RUNNING THREADS

[75] Inventors: Erwin Stolarski, Augsburg; Hans-Rüdiger Schröder, Birkach, both of Fed. Rep. of Germany

[73] Assignee: Hoechst Aktiengesellschaft, Fed. Rep. of Germany

[21] Appl. No.: 281,811

[22] Filed: Dec. 8, 1988

[30] Foreign Application Priority Data

Dec. 9, 1987 [DE] Fed. Rep. of Germany ..... 3741673

[51] Int. Cl.[5] ..... D01G 1/00; D01G 37/00

[52] U.S. Cl. ..... 19/0.6

[58] Field of Search ..... 19/0.6, 0.62; 30/124, 30/133, 134, 263, 264

[56] References Cited

FOREIGN PATENT DOCUMENTS 2400414 4/1979 France ..... 30/123

66839 4/1982 Japan ..... 30/124

*Primary Examiner*—Werner H. Schroeder

*Assistant Examiner*—D. Price

*Attorney, Agent, or Firm*—Connolly and Hutz

[57] ABSTRACT

A process for the guidance of rapidly running threads by means of a manipulator, in which the threads are drawn by the mechanical drawing-in device into the interior of the manipulator and are comminuted there by means of a cutting device, and the thread portions are ejected through an outlet orifice. The drawing-in and cutting devices of the manipulator preferably comprise a knife roller rotating in a narrow housing.

6 Claims, 4 Drawing Sheets

PROCESS AND MANIPULATOR FOR THE GUIDANCE OF RUNNING THREADS

The present invention relates to a manipulator and a process for the guidance of threads, but especially of monofilaments with high individual titers, during the starting phase of processing machines, such as, for example, drawing mechanisms or winding-on mechanisms.

In the production of filaments and yarns of the most diverse types, such as, for example, filament yarn or spun-fiber yarn, which will be referred to hereafter as a whole as "threads", and in the further processing of these, especially on spooling machines, it is necessary to guide the individual threads in the machine over deflecting rollers, combs fixed in place or other leading and processing stations. At the same time, the production process or the appropriate processing of the threads usually should not be interrupted. For this purpose, the threads have to be grasped and the thread quantity produced during threading-in or handling has to be conveyed away.

For relatively high running speeds of the threads, suction guns are known, and these essentially comprise a suction pipe with an injector effect, which can be connected to a compressed-air source in such a way that a flow occurs through the suction tube from the front end towards the rear end of the latter. The rear end of the suction tube, which also serves as a gripping piece, is often connected to an air-permeable vessel or terminates in such as this, so that, as a result of the suction effect, the thread can be sucked into the suction pipe and deposited in the vessel. At the same time, the thread which continues to arrive can be handled via the front end of the suction gun, for example looped over galettes or over a winding-on device. However, there are sometimes difficulties in sucking in the arriving thread into the front end of the suction pipe counter to the thread tension exerted on it in the particular machine. Particular difficulties arise, here, with regard to monofilaments which offer scarcely any engagement surface to the suction exerted at the front end of the suction pipe, especially when they have a high titer and are correspondingly rigid. In contrast to this, multifilaments, twisted threads or tapes can be grasped much more easily by a suction gun. Especially where monofilaments are concerned, even increasing the pressure step and consequently intensifying the suction effect do not achieve any improvement. In this case, there is also the danger that the filament will come askew in front of the orifice of the suction pipe and the suction will not be sufficient to cause it to experience looping at the start of the suction pipe. Where monofilaments are concerned, the result of this has already been that the particular machines can be operated or at least started only at a speed at which the threading-in and feeding of running monofilaments are still just possible by hand.

DE-A-3,517,117 shows, as a partial solution, a suction gun for monofilaments, which corresponds substantially to known suction guns for other threads, but which has a thread catcher introducing the monofilament mechanically into the suction pipe. There is also a cutting-off device for the monofilament which has already arrived. However, this device does not solve the problem of also conveying away the flexurally rigid monofilaments.

European Patent Applications No. 0,230,974 and No. 0,241,850 relate to thread draw-off appliances which are intended to make it possible to exert a sufficiently high draw-off tension even on threads which run at very high speeds. In these appliances, the pneumatic drawing-in and the pneumatic conveyance of the threads are assisted by mecnanical drawing-in members. These comprise a conical roller or two rollers not touching one another and with axial directions intersecting at an acute angle, which rotate at a sufficiently high circumferential speed and round which the thread to be drawn in is looped in several turns.

After the thread has run off from the rollers, it is transported further pneumatically either in smooth form or as a coil. These known appliances do not overcome the considerable difficulties arising when relatively rigid threads, such as, for example, monofilaments of higher titer, are grasped, especially when these are under relatively high tension in the spinning apparatus, and they do not solve the problem of conveying away the drawn-in threads in a faultless manner.

The object on which the present invention is based is, therefore, to provide a process and a device, by means of which even running threads difficult to grasp, such as monofilaments particularly, can be handled reliably.

According to the invention, this object is achieved by means of a process and a manipulator for the guidance of running threads, in which the thread material is drawn in and transported mechanically, comminuted mechanically and conveyed away in comminuted form.

The manipulator according to the invention, like conventional devices, has a draw-in orifice and an outlet orifice for the filaments and differs from the types known hitherto in that it possesses a mechanical drawing-in device which draws the filaments through the draw-in orifice into the interior of the appliance and which transports them to a cutting tool cutting the threads into small portions which are ejected through the outlet orifice. Furthermore, the manipulator according to the invention contains a drive unit, by means of which the mechanical drawing-in device and the cutting device are driven.

For practical reasons, the manipulator according to the invention is given an elongate form, the draw-in orifice for the threads being located near one end, on the opposite end of the manipulator being designed as a gripping piece.

BRIEF DESCRIPTION OF THE DRAWINGS

FIGS. 3*a* and 3*b* illustrate another embodiment of a thread manipulator according to the present invention, wherein FIG. 3*a* is a section view taken along line IIIa—IIIa of FIG. 3*b*, and wherein FIG. 3*b* is a section view taken along line IIIb—IIIb of FIG. 3*a*.

FIGS. 4*a* and 4*b* illustrate another embodiment of a thread manipulator according to the present invention, wherein FIG. 4*a* is a section view taken along line IVa—IVa of FIG. 4*b*, and wherein FIG. 3*b* is a section view taken along line IIIb—IIIb of FIG. 3*a*.

FIG. 1 shows a longitudinal section through a manipulator according to the invention in a diagrammatic representation. Located at the front end of the appliance is the draw-in orifice (1) which opens into the draw-in channel (2). The thread runs through the draw-in channel to the mechanical drawing-in device (3) which transports it further through the connecting channel (7) and which feeds it to the cutting device (4). The cut filaments pass through the outlet orifice (5) into the open or can be collected in a collecting container. The drawing-in device (3) and the cutting device (4) are driven from the drive unit (8) via a power transmission (9). Finally, FIG. 1 also indicates a gripping piece (6) which is intended to make it easier to guide the manipulator.

Figure 1:
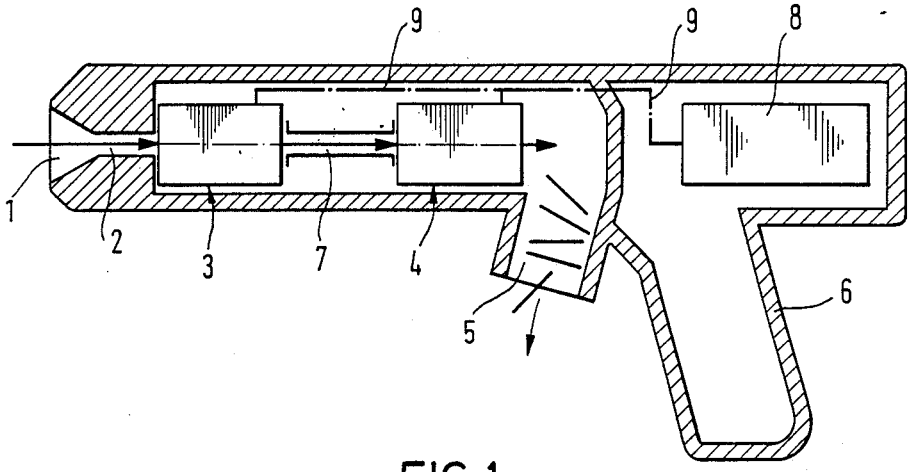
FIG. 1 shows a longitudinal section view of a thread manipulator according to the present invention.

The mechanical drawing-in device appropriately comprises a rotating roller-shaped constructional element which draws the thread into the draw-in orifice, for example as a result of friction on its surface, by pinching, for example, in a nip or by virtue of a surface formation which can hook into the surface of the thread to be transported, and which feeds it to the cutting device. Depending on the design of the mechanical drawing-in device, the thread transport can take place positively or non-positively. Non-positive transport is preferred, the drive unit appropriately containing an electric or compressed-air motor and being designed so that it drives the transport device at a freely selectable speed. It is also highly advantageous to equip the drive unit of the manipulator with a regulating device for the rotational speed of the thread drawing-in device, the rotational speed and consequently the drawing-in speed of the thread being regulated so that the drawn-in thread is always under a preselected tensile stress. Regulating devices of this type for electrical drive units are known and are used, for example under the designation of "torque control", in hand drills, electric screwdrivers and the like.

A preferred embodiment of the drawing-in device is a roller equipment on its circumference with knives, the cutting edges of which are essentially in the axial direction or extend spirally over the roller casing, the said roller rotating in a housing, surrounding it at a specific short distance, and transporting the thread in the interspace between the knife cutting edges and the housing wall.

The draw-in orifice for the thread is positioned in the housing of the manipulator in such a way that the thread, when introduced, can be grasped by the mechanical transport members and drawn in. For this purpose, it is expedient if the draw-in orifice opens into a draw-in channel which gives the thread a direction bringing it into non-positive connection with the transport member. If, for example, a roller with a mating roller is used as a drawing-in member, the draw-in channel appropriately opens out in the vicinity of the nip. If the drawing-in member comprises a knife roller rotating in a housing surrounding it very closely, the draw-in orifice opens into a draw-in channel, the direction of which is a secant of the circle described by the rotating knife cutting edges. It is preferable if this secant intersects the radius R of the knife circle perpendicular to it at a distance r=(0.5 to 0.9).R from its mid-point. It is especially advantageous if the secant intersects the radius at a distance r from the mid-point of the knife circle which is obtained, as a function of the number n of knives attached to the roller, from the formula $$r = R \cdot \cos\left(\frac{180^\circ}{n}\right)$$

The mechanical cutting device of the manipulator according to the invention can, in principle, have any known embodiment which can be accommodated in a handy housing. A mechanical cutting device with a rotating cutting tool is appropriately used. A preferred cutting device has a rotating roller which is equipped with knives and the knife cutting edges of which extend essentially in the axial direction or have a spiral arrangement rotating in a housing surrounding it at a specific distance, the distance between the housing inner wall and the knife cutting edges in the region of the thread entry preferably being such that the thread is grasped by the knives, taken up, but not yet cut, and then narrowing increasingly in the direction of rotation, the threads being cut off in the region where the distance between the housing inner wall and the knife cutting edges falls below a critical minimum distance.

By means of the ejection orifice of the manipulator according to the invention, the thread portions can be ejected into the open or can be collected in a collecting container attached to the ejection orifice. Preferably, the ejection of the thread portions is assisted by an airstream.

Figure 2:
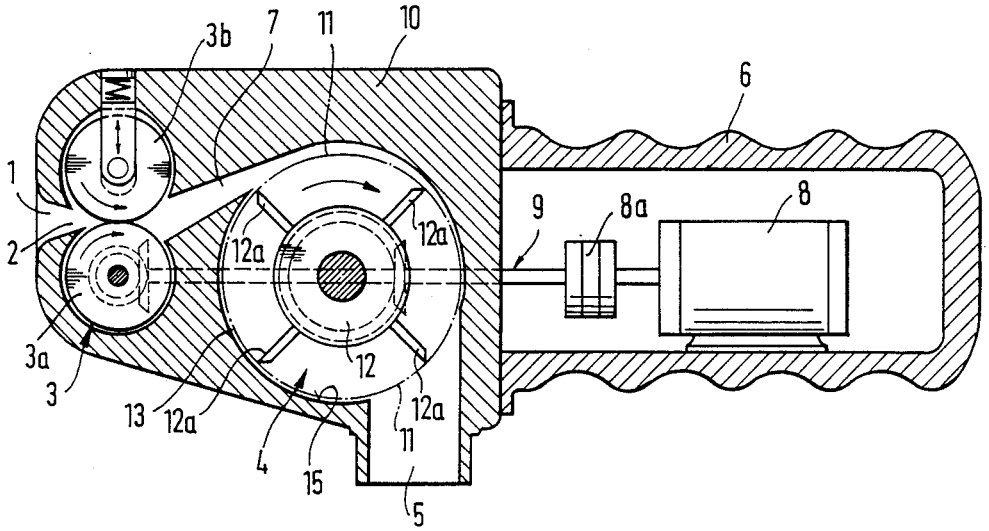
FIG. 2 shows a section view of another thread manipulator according to the present invention.

FIG. 2 illustrates diagrammatically a device according to the invention, in which the drawing-in device is formed by a roller (3*a*) driven by means of the power transmission (9) and by the mating roller (3*b*) (pressing-on device shown diagrammatically in the drawing) pressed elastically against the said roller (3*a*), and the cutting device (4) is formed by a roller equipped with knives on its circumference. In this case, the funnel-shaped draw-in orifice (1) opens out in the immediate vicinity of the draw-in nip of the pair of rollers, so that a thread end introduced through it or a thread loop is grasped by the rotating rollers (3*a*) and (3*b*) and drawn in. As a result of its rigidity and elasticity, the drawn-in thread is pushed through the connecting channel (7) of the cutting device (4). This comprises a roller which is equipped with knives and which rotates in a narrow roller cage formed by the inner wall of the housing (10). In an exaggerated representation for the sake of clear illustration, at the mouth of the connecting channel the distance between the housing inner wall and the knife circle (11) of the roller is widened to such an extent that the arriving thread is initially grasped by the knives and taken up. This distance then decreases in the direction of rotation to such an extent that the thread located between the housing wall and the knives is cut off. The thread portions obtained pass through the outlet orifice (5) into the open or into a collecting container. Accommodated in the gripping piece (6) of the device according to the invention, shown diagrammatically in FIG. 2, is the drive unit (8) which drives the two drawing-in rollers and the knife roller via the power transmission (9). Additionally, a non-positive coupling (8*a*), for example a hydraulic or a magnetic coupling, is inserted in the power-transmission path here.

In a preferred embodiment of the manipulator according to the invention, the drawing-in and cutting of the threads are carried out by one and the same knife roller. In this respect, the statements made above with regard to the knife rollers used for drawing in and for cutting apply to the arrangement of the knives on this knife roller and to the geometry of the thread feed. In this embodiment, the feed of the threads to the knife roller and their cutting appropriately take place at an angular distance $\alpha$ of 90° to 270° C.

In such a preferred manipulator, it has proved especially advantageous if the narrowing of the distance between the housing wall and the knife cutting edges, resulting in the cutting of the threads, occurs in the region of an exchangeable housing part. It has also proved advantageous to cause the knive roller to run in a housing surrounding it very closely and to provide the specific distance necessary for the thread draw-in by means of a groove which is cut in the housing inner wall and the depth of which decreases to zero in the region of the cutting point of the threads. The draw-in channel for the threads opens out in this groove and at the same time defines the start of the latter.

Figure 3B:
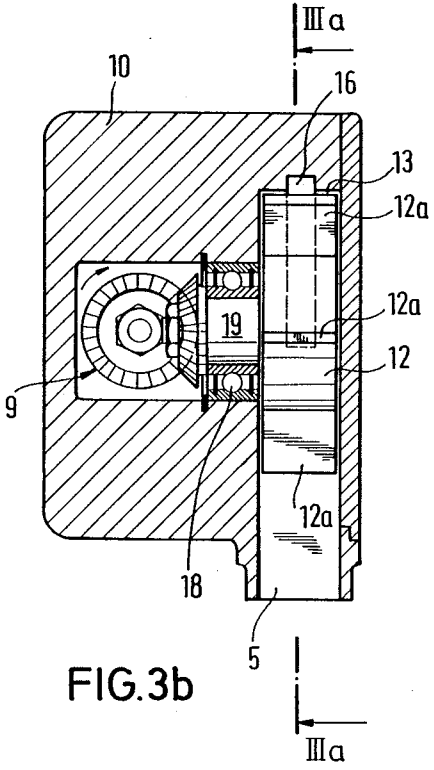
Figure 3A:
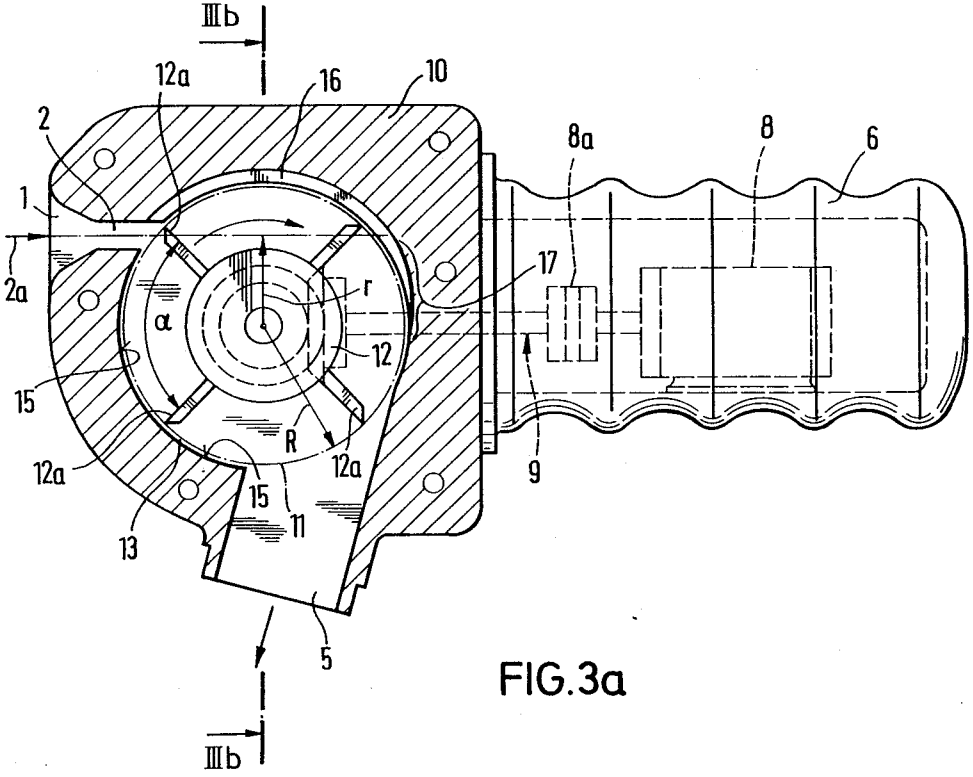

FIG. 3*a* shows diagrammatically a cross-section through such an especially preferred embodiment in the sectional plane IIIa—IIIa marked in the longitudinal section of FIG. 3*b*. FIG. 3*a* shows the drawing-in and cutting roller (12) which rotates in the housing (10) at a gap distance (13) between the knife circle (11) and the housing inner wall (15) and which is equipped with knives (12*a*). Furthermore, the section shows the draw-in orifice (1) and the draw-in channel (2), the direction (2*a*) of which forms a secant of the knife circle. Moreover, the Figure shows at (16), in an exaggerated representation for clear illustration, the enlarged gap distance between the knife circle and the housing inner wall in the continuation of the draw-in channel (2) and the narrowing of this gap distance in the cutting region (17). The longitudinal section of FIG. 3*b* shows, in addition to the housing (10), the knife roller (12) with the knives (12*a*) and the widened gap (16) between the knife circle and the housing inner wall, the encased ball bearing (18), in which the knife shaft is mounted in the housing, and the end of the knife shaft (19) connected to a drive unit (8).

Conventional milling heads can be used successfully as rollers equipped with knives for the thread transport and the thread comminution. A conventional milling head can also be used as a knife roller in the preferred embodiment illustrated in FIGS. 3*a* and 3*b*.

The work with the manipulator according to the invention can, in principle, be carried out in such a way that the start of the thread to be manipulated is introduced into the draw-in orifice of the appliance so far that it comes into non-positive connection with the drawing-in element and from that moment on is drawn in further automatically. If the thread is a running thread, a thread start can easily be obtained by cutting off the thread quantity already run out.

Difficulties can arise when the threads run at very high speed. In this case, it is advantageous to design the manipulator according to the invention so that even a running thread can be grasped directly by the mechanical drawing-in device and fed to the cutting device. This can be carried out, for example, by a mechanical auxiliary device which is known per se from the art of suction guns and which makes it possible to catch the running filament and bring it into the drawing-in range of the drawing-in device. It is also possible to design the housing of the manipulator according to the invention so that the running thread can be brought directly so far up to the drawing-in element that it can be grasped by this, drawn in and fed to the cutting device. Thus, when a rotating roller is used as a drawing-in member, a slot closeable if appropriate can be made, for example, in the roller housing, so that the straight line connecting its lowest points forms a secant of the drawing-in roller, and consequently a running thread inserted into this slot can be grasped by the rotating roller surface and drawn into the manipulator.

In a preferred embodiment of the manipulator according to the invention, in which one and the same knife roller performs both the drawing in of the threads and their cutting, the possibility of inserting running filaments can be afforded if the housing is divided in the region of the knife roller in such a way that the division extends through the draw-in orifice, and the housing parts can be set so far apart from one another that there is a continuous gap, in which the running thread can be inserted in such a way that it lays itself over the rotating knife roller, is taken up by the latter and is guided to the cutting position. A corresponding design of the manipulator according to the invention is shown diagrammatically in FIG. 4.

Figure 4B:
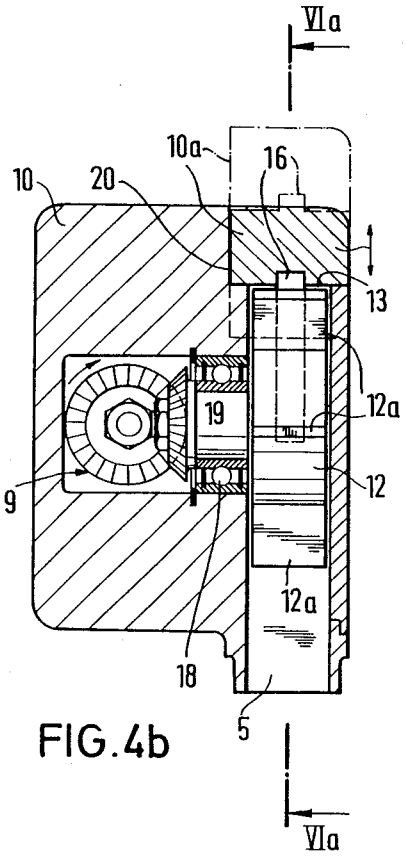
Figure 4A:
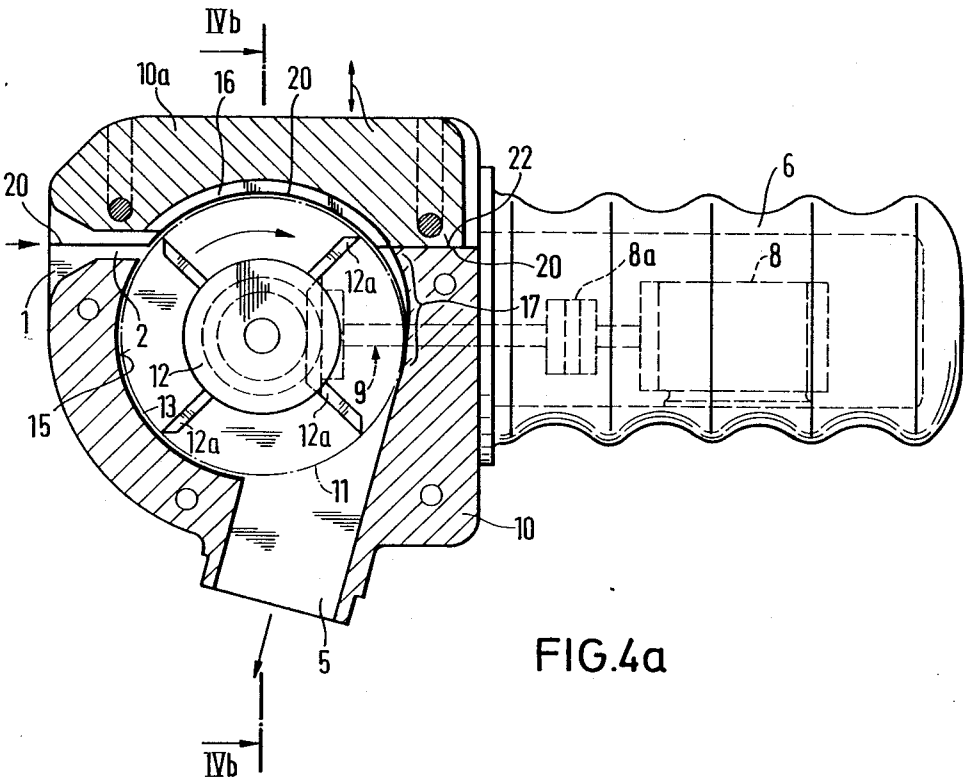

FIGS. 4*a*, and 4*b* show the preferred embodiment of the manipulator according to the invention of FIGS. 3*a* and 3*b*, but in which, in order to simplify the insertion of running threads, the upper housing part (10*a*) can be lifted off a specific amount D from the rest of the housing. The division of the housing extends along the lines (20), and it can be seen that the dividing line runs through the draw-in channel (2).

Figure 5:
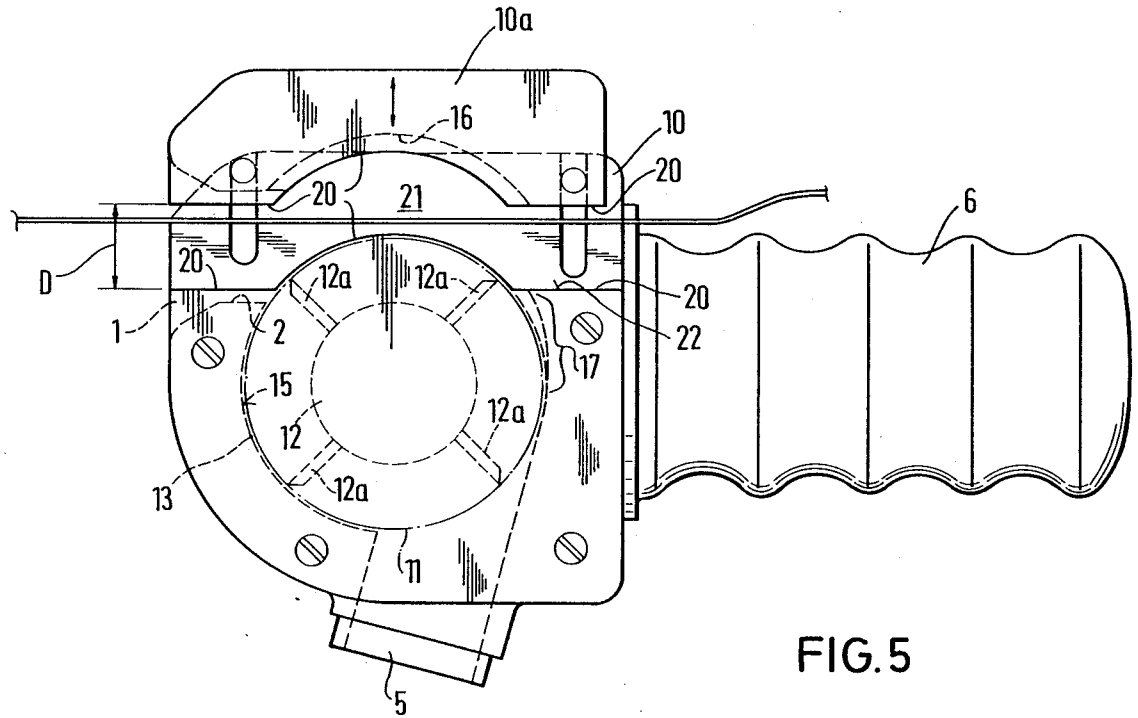
FIG. 5 shows the embodiment of FIG. 4*a*, with the movable part of the housing removed.

FIG. 5 shows a side view of the device according to the invention, as illustrated in FIG. 4*a*, but in which the movable part of the housing (10*a*) has been lifted off from the housing by the amount D, there forming a continuous gap (21), into which the running thread can easily be inserted in such a way that it comes to rest over the rotating knife circle. It is clear that, when the lifted-off housing part (10*a*) is lowered, the thread is gripped between the two housing parts at the point (22) and is then taken up by the knife roller into the cutting region (17) where cutting takes place.

The insertion of a running filament into the opened housing gap can be made even easier if the housing is equipped with projections (not shown) which form a funnel-shaped widening of the opening housing gap.

The essential advantage of using the manipulator according to the invention is its universal practicability for the guidance of rapidly running threads of all types, especially even those having high rigidity, such as, for example, high-titer monofilaments, and which for this reason cannot be handled with conventional pneumatic appliances.

A further advantageous possibility of use of the appliance according to the invention is the reprocessing of thread waste, especially waste quantities of coarse-tieter monofilaments.

Thus, it is possible to bring into a handleable and recyclable form the filament quantities which have been spun off in the start-up phase of a spinning apparatus before the setting of constant filament properties and which, especially where relatively rigid material is concerned, form a no longer handleable bulky heap in a very short time.

Of course, the material is defective spools can also be reprocessed easily and, if appropriate, returned to the spinning process.

We claim:

1. A manipulator for the guidance of running threads, with a draw-in orifice for the threads, an out-let orifice and a gripping piece, including a narrow housing and a single knife roller rotating within the narrow housing for drawing in and cutting the threads, and a drive unit for rotating the single knife roller.

2. A manipulator as claimed in claim 1, wherein the knife roller is a milling cutter.

3. A manipulator as claimed in claim 1, wherein the drive unit contains an electric motor or a compressed-air motor.

4. A manipulator as claimed in claim 1, wherein the narrow housing is open at a dividing point to form a slot, into which the running thread is inserted in such a way that it comes to rest over the rotating knife roller.

5. The use of a manipulator as claimed in claim 1 for the guidance of rapidly running threads.

6. The use of a manipulator as claimed in claim 1 for the reprocessing of thread waste.

* * * * *